United States Patent [19]

Silverman et al.

[11] Patent Number: 5,053,786

[45] Date of Patent: Oct. 1, 1991

[54] BROADBAND DIRECTIONAL ANTENNA

[75] Inventors: Lawrence H. Silverman, Dix Hills; Shakeel Siddiqi, Farmingdale, both of N.Y.

[73] Assignee: General Instrument Corporation, New York, N.Y.

[21] Appl. No.: 152,466

[22] Filed: Feb. 5, 1988

Related U.S. Application Data

[63] Continuation of Ser. No. 343,525, Jan. 28, 1982, abandoned.

[51] Int. Cl.[5] ..... H01Q 1/36

[52] U.S. Cl. ..... 343/895

[58] Field of Search ..... 343/895, 700 MS File, 343/739, 749, 820, 851

[56] References Cited

U.S. PATENT DOCUMENTS

| | | | |
|---|---|---|---|
| 4,012,744 | 3/1977 | Greiser | 343/895 |
| 4,085,406 | 4/1978 | Schmidt et al. | 343/895 |
| 4,095,230 | 6/1978 | Salmond et al. | 343/895 |
| 4,114,164 | 9/1978 | Greiser | 343/895 |
| 4,319,248 | 3/1982 | Flam | 343/895 |
| 4,459,596 | 7/1986 | Flam | 343/895 |
| 4,609,888 | 9/1986 | Corzine et al. | 343/895 |

*Primary Examiner*—William L. Sikes
*Assistant Examiner*—Robert E. Wise
*Attorney, Agent, or Firm*—Hopgood, Calimaede, Kalil, Blaustein & Judlowe

[57] ABSTRACT

A broadband antenna includes a center fed active radiating/receiving element formed of two contiguous conductive spirals. The two planar antenna spirals are secured to a cavity loaded with a wave absorbing lossy material such that the antenna is operative only in its front lobe direction opposite the loaded cavity.

In accordance with the present invention, the cavity wall is formed of varying pattern of conductive and insulative material. The resultant composite antenna is characterized by a relatively narrow beam pattern for both horizontally and vertically polarized electric waves across a broad spectrum of frequencies.

6 Claims, 1 Drawing Sheet

BROADBAND DIRECTIONAL ANTENNA

This is a continuation of co-pending application Ser. No. 343,525 filed on Jan. 28, 1982, now abandoned.

DISCLOSURE OF THE INVENTION

This invention relates to electronic wave propagation and, more specifically, to an improved broadband antenna configuration.

It is an object of the present invention to provide improved antenna apparatus.

More specifically, it is an object of the present invention to provide a compact, broadband high frequency antenna.

Yet a further object of the present invention is the provision of a broadband antenna characterized by a relatively narrow directional response for both horizontal and vertically polarized waves throughout a broad operative frequency spectrum.

The above and other objects of the present invention are realized in a specific, illustrative composite broadband antenna comprising a center fed active radiating-/receiving element formed of two contiguous conductive spirals. The antenna spiral element is secured to a cavity loaded with a wave absorbing lossy material such that the antenna is operative only in its front lobe direction opposite the loaded cavity.

In accordance with the present invention, the cavity wall is formed of varying pattern of conductive and insulative material. The resultant composite antenna is characterized by a relatively narrow beam pattern for both horizontally and vertically polarized electric waves across a broad spectrum of frequencies.

Figure 1:
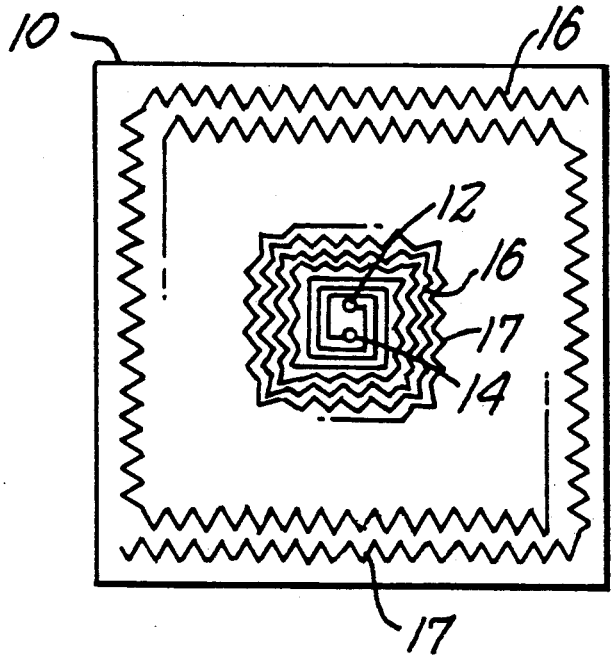
Figure 2:
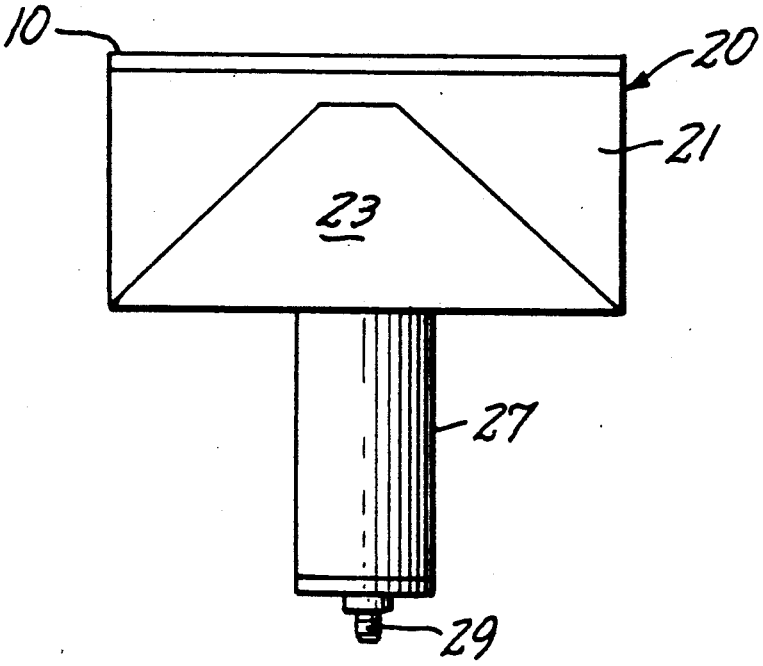

The above and other features and advantages of the present invention will become more clear from the following detailed description of a specific, illustrative embodiment thereof presented hereinbelow in conjunction with the accompanying drawing, in which:

FIG. 1 is a schematic top view of an antenna structure illustrating the principles of the present invention; and FIG. 2 is a side view of such antenna structure.

Referring now to the drawing, there is shown in FIG. 1 a top view of an antenna formed of a planar structure 10 comprising two conductive spiral-like antenna paths 16 and 17. The spiral antenna conductors are center fed as at conductive lands 14 and 12 respectively. Each of the conductors 12, 14, 16 and 17 may be formed on an insulative substrate, e.g., fiberglass, in any manner well known to those skilled in the art.

The contiguous conductive paths 16 and 17 form a composite active spiral antenna per se well known to those skilled in the art. Moreover, as is also per se well known, individual portions of the spirals 16 and 17 may be of serpentine-like form to generate a longer electrical path length for a given linear distance traversed vis-a-vis spirals formed of a straight line to reduce the substrate area consumed for any desired operative frequency path. Spiral antennas are relatively broadband devices covering a range of frequencies roughly corresponding to frequencies for which one circumference corresponds to one electrical wave length. Thus, as a general matter a spiral antenna is operative for range of frequencies wherein the shorter circumference loops about the inner portion of the spiral defined the upper frequency cutoff; while the substantially longer path lengths about the outer portion of the antenna define the lower operative frequencies for the active radiating-/receiving element.

The planar antenna structure 10 is secured to a cavity 20 (FIG. 2) discussed below. Projecting from the rear of the cavity 20 is a section 27 containing a balun with the composite antenna terminating at a connector 29 amenable for connection for example, to coaxial cable. For antenna transmission, a single ended signal present at the connector 29 and a cable connected thereto is converted to a form balanced with respect to ground by the balun 27 as is per se known, with the oppositely poled, balanced signals being connected to the antenna lands 12 and 14. An inverse balanced-to-single ended operation is effected by the balun for antenna signal reception.

The cavity 20 includes material for absorbing any backward radiation from the antenna, i.e., any radiation in a downward direction in FIG. 2. That is, the material in the cavity 20 suppresses the rearward lobe of the antenna which is thus operative only in a forward direction for both signal reception and transmission. Reverse direction wave suppression materials are again well known and understood by those skilled in the art and may comprise, for example, ferrite or a honeycomb-shaped conductive material.

It is desired that the composite antenna of FIGS. 1 and 2 be directional, i.e., provide a relatively narrow forward beam pattern for both horizontal and vertically oriented electromagnetic waves. To this end, the outer walls of the cavity 20 are formed with an electrically conductive portion 23 and an electrically insulator portion 21 having a regular but varying interface therebetween. Such a cavity wall may be formed, for example, by beginning with an insulator substrate sheet material such as fiberglass having a conductive sheet material 23 fully covering the substrate. The conductive material is then selectively etched away to the desired pattern shown in FIG. 2 by any conductor removing etching process well known in the art. Other ways may be employed as well to form the sheet material in a pattern such as that shown in the drawing—most simply by adhering a properly shaped conductor to the insulating wall. The conductive sheet 23 should exceed the skin depth thickness for all anticipated frequencies. The conductive material 23 is electrically grounded, having an electrical connection with the outer wall of balun cavity 27 and the grounded outer conductor of the connector 29.

In accordance with one aspect of the present invention, the antenna cavity so formed produces the desired antenna directivity for both horizontally and vertically polarized waves—a desideratum for many antenna purposes, e.g., those used in sensitive or security applications, private communications, direction finding applications, or the like. Where a fully conductive outer surface of cavity 20 is not employed, the desired directivity is obtained for incident horizontally polarized waves at the lower frequency portion of the frequency range for the accompanying spiral antennas 16–17. Correspondingly, where no metal is employed for the outer surface of cavity 20, i.e., where the cavity walls are entirely formed of a non-conductive metal, directivity is relatively poor for vertically polarized waves (relative to the orientation of the antenna lands 12 and 14) for vertically polarized waves about the upper frequency portion of the antenna reception. Accordingly, to obviate the deleterious antenna lobe broadening above discussed, the metal surface for wall 23 is made relatively large about the central or high frequency portion of the antenna to preserve the vertical wave directivity; and made small and remote from the antenna 10 about the outer extremities of the antenna to preserve the horizontal frequency directivity. The pattern shown in side view in FIG. 2 is repeated about the other three sides of the antenna as well to a like end.

Accordingly, the composite antenna shown in the drawing and described above is compact; provides a broad frequency response while suppressing reverse direction wave propagation or reception; while also preserving a narrow, directive transmitting and receiving pattern for both vertically and horizontally polarized waves across the operative frequency spectrum for the unit.

The above described arrangement is merely illustrative of the principles of the present invention. Numerous modifications and adaptations thereof will be readily apparent to those skilled in the art without departing from the spirit and scope of the present invention. Thus, for example, transitions other than linear may be employed between the conductive and insulative portions of the antenna cavity wall. Moreover, circular or other non-square antenna cavities may be employed as well, utilizing a partial insulative/partially conductive pattern about the circumference of the cavity wall.

What is claimed is:

1. In combination, active antenna means, and antenna lobe suppressing chamber means coupled to said active antenna means, said active antenna means comprising two co-planar proximate spiral conductive paths, said chamber means including an outer housing wall and interior wave absorbing means, said outer housing wall comprising a composite sidewall structure including a first portion formed of an insulator material and a second portion formed of a conducting material, said first and second portions having a continuous interface spaced from said active antenna means at different distances, separating the wall into a first area comprising the first portion and a second area comprising the second portion, said second area being positioned and dimensioned to be relatively larger about the central or high frequency portion of the antenna so as to preserve the vertical wave directivity, whereby said active antenna means exhibit a broadband, directional characteristic for both horizontally and vertically polarized waves.

2. A combination as in claim 1 further comprising balun means connected to each of said two spiral conductive paths.

3. A combination as in claim 1 or 2 wherein each of said two spiral conductive paths have serpentine-like portions.

4. A combination as in claim 1, wherein each side of the chamber outer housing wall is rectangular and wherein said second area of each side of said wall is larger and closer to said active antenna means about the central portion of each side of said chamber outer wall than at the end portion thereof.

5. A combination as in claim 1 wherein said interior wave absorbing means consists of ferrite.

6. A combination as in claim 1 wherein said interior wave absorbing means consists of a honeycomb-shaped conductive material.

* * * * *